United States Patent [19]

Trottier et al.

[11] 4,435,360

[45] Mar. 6, 1984

[54] METHOD OF MANUFACTURING METAL PIECES BY CASTING AND SINTERING OF A METAL ALLOY POWDER

[75] Inventors: Jean-Pierre Trottier, Bagneux; Michel Jeandin, Paris, both of France

[73] Assignees: A.R.M.I.N.E.S.; S.N.E.C.M.A., both of Paris, France

[21] Appl. No.: 353,110

[22] Filed: Mar. 1, 1982

[30] Foreign Application Priority Data

Feb. 27, 1981 [FR] France ..... 81 03904

[51] Int. Cl.[3] ..... B22F 3/00

[52] U.S. Cl. ..... 419/49; 419/54; 419/42

[58] Field of Search ..... 419/49, 54, 42

[56] References Cited

U.S. PATENT DOCUMENTS

| | | | |
|---|---|---|---|
| 3,562,371 | 2/1971 | Bush | 419/49 |
| 4,023,966 | 5/1977 | Loersch et al. | 419/49 |
| 4,212,669 | 7/1980 | Veek et al. | 419/49 |

OTHER PUBLICATIONS

Publication "Advancements in Superalloy Powder Production and Consolidation", by Louis J. Fiedler.

Publication "Manufacture of Low Cost P/M Astrology Turbine Disks" by Dennis J. Evans.

*Primary Examiner*—Brooks H. Hunt

*Attorney, Agent, or Firm*—Oblon, Fisher, Spivak, McClelland & Maier

[57] ABSTRACT

A method of manufacturing metal pieces by casting and sintering of a metal alloy powder of the type that includes two phases, a conforming phase during which a load of powder is heated inside a formal casting to execute a rigid preform which is porous and a compacting and sintering phase during which the preform is heated under isostatic pressure. The method and resulting metal piece is characterized in that the conforming phase is conducted so that the preform has open pores and the isostatic pressure is applied by way of an envelope that distorts and is airtight. The method is applied advantageously in the execution of complex formal pieces made of superalloys or made of a titanium alloy.

9 Claims, 5 Drawing Figures

METHOD OF MANUFACTURING METAL PIECES BY CASTING AND SINTERING OF A METAL ALLOY POWDER

BACKGROUND OF THE INVENTION

1. Field of the Invention

The invention concerns a method of manufacturing formal metal pieces by casting and sintering of a metal alloy powder. The expression "formal" means that the pieces that are obtained by the method are within the shapes and measurements as desired and do not have to be subjected later to a shaping treatment by mechanical distortion. The expression "metal alloy powder" is indicative of the fact that the implemented powder is a powder made of alloy grains, the composition of which is not significantly altered by the execution of the method.

The method of the invention is applied especially to the execution of pieces made of superalloys with a cobalt and/or nickel base or still made of titanium-based alloys. It is of the type that includes first a conforming phase which includes the following operations: introduction of a load of metal alloy powder into a formal casting, heating of the casting under temperature and time conditions that enable obtaining a solid but porous element (which will be called "preform"), and secondly a compacting and sintering phase during which the preform is subjected to a thermal treatment under isostatic pressure and temperature, length and pressure conditions that enable obtaining a compact piece, entirely or mostly without porousness.

2. Description of the Prior Art

Methods such as this one are already familiar. Theoretically, it is possible to substitute one for another advantageously, for obtaining complex shaped metal pieces made of superalloys or of titanium alloys, to the methods that implement tooling inside the mass or isothermic forging at a superplastic phase because they do not display the disadvantages such as significant losses of matter, or further still the number and length of the operations, cost and complexity of the instruments, etc.

An application example of the previously mentioned method is briefly described in the publication by Louis J. Fiedler entitled "Advancements In Superalloy Powder Production And Consolidation" which appeared in "Agard Conference Proceedings No. 200, April 1976", pages 4B-1 to 4B-9. This example concerns the execution of nickel superalloy pieces. The conforming phase is achieved inside a formal rigid casting, heated at 1246 degrees C. in such a way that the executed preform is porous but its pores are closed. Otherwise, the pores do not communicate amongst themselves and do not lead to formation of a passage leading to the outside. During the compacting and sintering phase, the preform is subjected directly to isostatic pressure. This method actually displays two disadvantages, both produced by the fact that the pores must be closed, lest the isostatic pressure can not be applied directly to the preform.

On the one hand, in order to assure that the pores are closed, the heating temperature during the conforming phase must reach a value such that a liquid phase must appear inside the contact zones of the grains. However, if this temperature becomes too high, the ratio of melted and reconsolidated alloys becomes too high, resistance to distortion by compression of the preform becomes too high and isostatic pressure is inadequate. The range of satisfactory temperatures is therefore extremely narrow and difficult to heed.

On the other hand, densifying during this conforming phase reaches a significant value and triggers a shrinkage, the value of which is extremely close to the overall shrinkage as a result of the two phases. In other words, during the conforming phase most of the shrinkage takes place. In some parts of the preform and especially in the concave parts, the preform does not adopt the shapes of the casting anymore. Shrinkage cracks also appear. It therefore is not possible to obtain healthy pieces that have both a complex shape and precise measurements.

SUMMARY OF THE INVENTION

The purpose of the invention is to avoid the aforementioned disadvantages. The method of the invention, which includes the method of the prior art that has just been described, the conforming phase and the compacting and sintering phase which were defined at the outset of this description, is characterized in that the temperature conditions and those of the length of the conforming phase are such that the preform is not only porous, but its pores remain open and, for the execution of the compacting and sintering phase, the preform is previously placed inside a tightly sealed and stretchable metal envelope to which isostatic pressure is applied.

Thus, it is enough for the execution of the conforming phase that the temperature and length conditions are such that the alloy powder grains are linked to one another by their initial contact points, for instance through intersolid diffusion. There is neither fusion, nor subsequently, reconsolidation. The admissible temperature range is much wider than in the method of the prior art that was previously mentioned. Indeed, by adjusting the heating length, one can calibrate the temperature between a lower limit above which diffusion begins and an upper limit over which fusion begins. Conforming conditions are therefore much less critical. Furthermore, shrinkage during that conforming phase is much weaker and most of the overall shrinkage is achieved during the compacting and sintering phase. The preform adopts to the sides of the casting and there is no chance for cracks to appear while shrinkage during the second phase is almost entirely isotropic. All that is needed is for the envelope to suffer enough distortion so that it can be applied against all the sides of the preform.

It should be noted that it was already suggested that superalloy models be executed (instead of formal fitted pieces) by the metalwork of powders implementing, following consolidation, a compacting and sintering phase under isostatic pressure by way of the envelope. Examples will be found in the publication by Dennis J. Evans entitled "Manufacture of low cost P/M Atrology Turbine Disks" that also appeared in "Agard Conference Proceedings No. 200, April 1976" pages 4A-1 to 4A-6. But, on the one hand, those examples apply as already discussed to the execution of models for forging and the consolidation phase is not a conforming phase and, on the other hand, it is the consolidation casting that is used as an envelope during the compacting phase under isostatic pressure.

Compacting distorts the casting (which is either made of metal or ceramics) and therefore one must use a model casting. Furthermore, the casting must meet contradictory requirements since it must be adequately rigid to bear without distortion the conforming phase and sufficiently prone to distortion to be applied against the preform throughout the compacting and sintering phase. So, the method of the prior art does not make it possible to execute anything else except models. The method of the invention, on the other hand, allows for the execution of formal and complex pieces and the renewed use, if desired, of the conforming casting.

It is to be noted that the method of the present invention excludes the presence of a binding agent (such as zinc stearate) because of the use of a tightly sealed envelope during isostatic pressure. The method of the present invention is especially applicable for the execution of pieces derived from titanium powders for which thermal treatment is necessary. Indeed, in that particular instance, it is possible to undertake treatment of powders at high temperature, in relation to the compacting temperature, at the time of execution of the preform, for instance under vacuum in a ceramic casting. This high temperature treatment can be undertaken simultaneously with or after the powder gluing or bonding phase. This is made because the ranges of gluing or bonding temperatures and of thermal treatment are proximate.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Because the implementation parameters are not critical, especially as regards the conforming phase, the preferred embodiment is valid regardless of the desired composition. It applies especially to the implementation of nickel and/or cobalt-based superalloy pieces and titanium-based alloy pieces.

Figure 1:
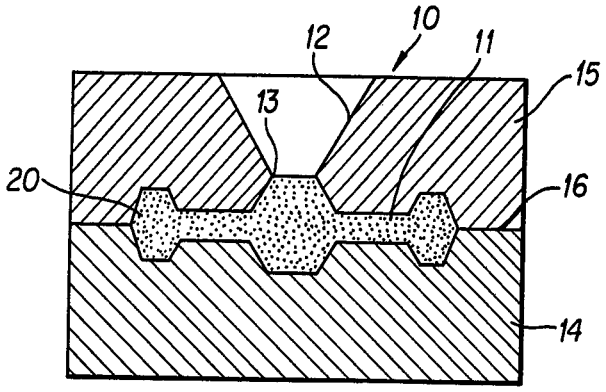
FIG. 1 is a sectional view of a conforming casting which contains a load of alloy powder in accordance with the present invention.

FIG. 1 shows the conforming casting 10 made of ceramic inside which the casting shape 11 is arranged inside which comes out the filling funnel 12 through which the load of alloy powder 20 is introduced. The homogeneous nature of the filling process is achieved, for instance, through vibration of the casting. The amount of alloy powder to be introduced is measured by weighing and is such that, when the filling process is finished, the powder load skims the upper limit 13 of the shape. As previously mentioned, the casting 10 can be rigid and unrecoverable, or, as in FIG. 1, removable and recoverable. Here it includes a lower casting part 14 and an upper casting part 15 separated by a flash line 16.

The filled casting 10 is then placed inside an oven (not shown) to be subjected there to the heat that is designed to compact the powder grains in order to obtain the preform. According to the alloys, the heating temperature is, as an example, 1100 to 1250 degrees C., and the heating period lasts for one hour, for example.

Figure 2:
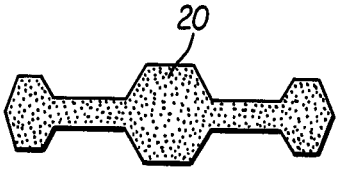
FIG. 2 is a sectional view of the corresponding preform that is obtained.
Figure 3:
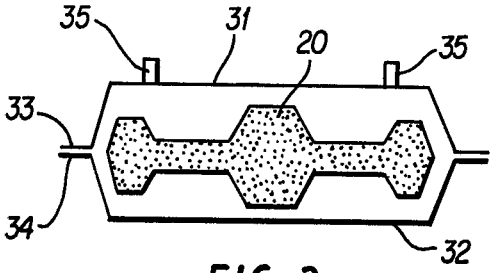
FIG. 3 is a sectional view of the preform placed in the distortable envelope, prior to execution of the compacting and sintering phase.

FIG. 2 shows the preform 20 as it was executed and decast. FIG. 3 shows preform 20 placed inside the envelope 30 designed for application of isostatic pressure during the compacting treatment. Envelope 30 is a thin envelope made of a metal fabric that is water-tight, and is easily distorted under treatment conditions, for instance ultra-soft steel ribbon. In FIG. 3, this envelope is made of two envelope parts 31 and 32, each in the shape of a plate. Parts 31 and 32 are equipped with round edges 33 and 34, respectively, that make possible water-tight assembly through soldering. It is to be noted that two filling stems 35 are utilized which are ultimately present so as to ensure pumping of air after soldering and the introduction of inert atmosphere (for instance, nitrogen) that cannot form a composite with the used alloy which would alter substantially the mechanical properties of the obtained piece. If compacting takes place in a vacuum, only one filling stem 35, designed for suction, is present. But the preferred solution is to place the envelope and the preform inside a structure that is under vacuum. The filling stems 35 are no longer needed since air escapes between the two edges 33 and 34. Soldering of the edges is ensured within the structure with an electron beam.

Figure 4:
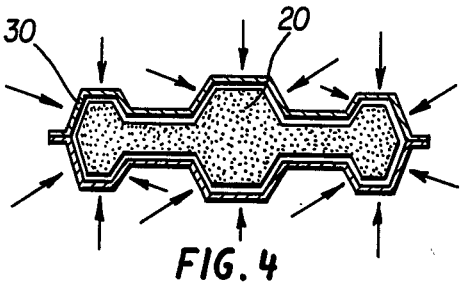
FIG. 4 is a sectional view of the resulting piece while still placed inside the envelope.
Figure 5:
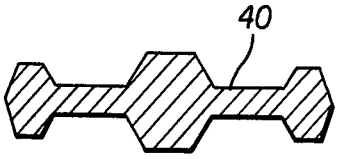
FIG. 5 is a sectional view of the resulting piece achieved extracted from the envelope.

FIG. 4 shows the envelope 30 and the preform 20 placed in a pan (not shown) used for compacting and sintering. Isostatic pressure which applies the envelope containing the preform is represented by arrows. Finally, FIG. 5 shows the piece 40 obtained after removal of the envelope 30, such removal being executed for instance by way of a selective chemical attack.

Because the casting 10 is used only during the conforming phase and the envelope 30 is used only during the compacting and sintering phase, their execution and the selection of materials which comprise them do not raise any particular difficulties. As already stated, the casting 10 can be executed in ceramic, whether monolithic or removable. With respect to the envelope 30, in most cases, it can be executed in ultrasoft steel ribbon.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for preparing a metal piece utilizing a formal casting and an nonconforming airtight casing of metal soldered ribbon of a predetermined thickness which comprises:

introducting a metal load of predetermined composition inside said formal casting;

heating said casting under predetermined temperature and time conditions so as to obtain a porous preform with a plurality of open pores;

decasting said preform;

introducing said preform inside said nonconforming airtight casing; and heating said preform under isostatic pressure so as to execute a formal metal piece via compactification and sintering such that said airtight casing is distorted under the action of said isostatic pressure and intimately contacts said preform to transmit said isostatic pressure to said preform.

2. A method according to claim 1, which further comprises removing said preform without destroying said casting.

3. A method according to claim 1, wherein said preform further comprises titanium powder and wherein said method further comprises bonding said powder and undertaking thermal treatment at a high temperature at the time of execution of the preform during the powder bonding.

4. A method according to claims 1, 2 or 3 wherein said nonconforming casing comprises a ductile metal envelope is utilized which further comprises placing the preform in said metal envelope and establishing an atmosphere in the metal envelope.

5. A method according to claim 4, wherein the establishing of an atmosphere in the metal envelope further comprises establishing a vacuum in the metal envelope.

6. A method according to claim 5, wherein the establishing of an atmosphere in the metal envelope further comprises airtightly closing said metal envelope by soldering and establishing a vacuum in the metal envelope.

7. A method according to claim 6, wherein the soldering further comprises electronic bombardment soldering.

8. A method according to claim 1, wherein the preform is selected from the group consisting of a superalloy with a nickel and/or cobalt base or a titanium alloy powder.

9. A method according to claim 1, wherein said preform further comprises titanium powders and wherein said method further comprises bonding said powder and undertaking thermal treatment at a high temperature at the time of execution of the preform after the powder bonding.

* * * * *